US011737593B2

(12) United States Patent
Kuzminski

(10) Patent No.: US 11,737,593 B2
(45) Date of Patent: Aug. 29, 2023

(54) INSULATED BEVERAGE SLEEVE ASSEMBLY

(71) Applicant: Fawn Kuzminski, Warren, PA (US)

(72) Inventor: Fawn Kuzminski, Warren, PA (US)

( * ) Notice: Subject to any disclaimer, the term of this patent is extended or adjusted under 35 U.S.C. 154(b) by 281 days.

(21) Appl. No.: 17/122,246

(22) Filed: Dec. 15, 2020

(65) Prior Publication Data

US 2022/0183489 A1 Jun. 16, 2022

(51) Int. Cl.
*A47G 23/02* (2006.01)
*F25D 31/00* (2006.01)
*B65D 81/38* (2006.01)

(52) U.S. Cl.
CPC ..... *A47G 23/0266* (2013.01); *B65D 81/3876* (2013.01); *F25D 31/007* (2013.01); *A47G 2023/0275* (2013.01)

(58) Field of Classification Search
CPC ..... A47G 23/0266; A47G 2023/0275; A47G 2023/0666; A47G 23/0683; B65D 81/3886; B65D 81/3876–3886; F25D 31/007; F25D 2303/0843; F25D 2331/805; F25D 3/08; F25D 2201/00; F25D 2331/00; F25D 31/006; F25D 2331/80–812
See application file for complete search history.

(56) References Cited

U.S. PATENT DOCUMENTS 5,564,568 A * 10/1996 Rankin et al. ..... F25D 3/08 206/446
6,349,846 B1 2/2002 Meza
7,677,056 B2 * 3/2010 Panganiban ..... F25D 2331/804 62/457.4
2008/0093370 A1 * 4/2008 Darsey ..... B65D 81/3876 220/739
2008/0128421 A1 6/2008 Ulbrand
2009/0084795 A1 * 4/2009 Kagen ..... F25D 3/08 220/505
2012/0118897 A1 * 5/2012 Davis ..... F25D 2303/084 220/592.01
2014/0061208 A1 3/2014 Boyd
2014/0284301 A1 9/2014 Coe
2015/0008232 A1 1/2015 Fidanza
2016/0213181 A1 7/2016 Gonzalez, II
2020/0140182 A1 * 5/2020 Adjeleian ..... B65D 81/3886

* cited by examiner

*Primary Examiner* — Elizabeth J Martin
*Assistant Examiner* — Dario Antonio Deleon
(74) *Attorney, Agent, or Firm* — Jonathan M. D'Silva; MMI Intellectual Property

(57) ABSTRACT

An insulated beverage sleeve assembly includes a cylinder that insertably receives a beverage container. A first flap is movably attached to the cylinder to close the cylinder. A second flap is movably attached to the cylinder to close the cylinder. A top insulator is releasably matable to the first flap to engage the beverage container. A bottom insulator is releasably matable to the second flap to engage the beverage container. Each of the top insulator and the bottom insulator are comprised of a thermally insulating material. A cooling sleeve is insertable into the cylinder to surround the beverage container. Moreover, the cooling sleeve is comprised of a refrigeratable material such that the cooling sleeve can be refrigerated thereby facilitating the cooling sleeve to cool the beverage container.

8 Claims, 9 Drawing Sheets

INSULATED BEVERAGE SLEEVE ASSEMBLY

CROSS-REFERENCE TO RELATED APPLICATIONS

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to beverage sleeve devices and more particularly pertains to a new beverage sleeve device for thermally insulating a beverage container.

(2) Description of Related Art Including Information Disclosed Under 37 CFR 1.97 and 1.98

The prior art relates to beverage sleeve devices including a variety of beverage sleeves which including a cover that is positionable in a closed position for enclosing a beverage container positioned in the beverage sleeve. In at least one instance a refrigeratable cooling sleeve is included that can be inserted into the beverage sleeve for cooling the beverage container.

(h) BRIEF SUMMARY OF THE INVENTION

An embodiment of the disclosure meets the needs presented above by generally comprising a cylinder that insertably receives a beverage container. A first flap is movably attached to the cylinder to close the cylinder. A second flap is movably attached to the cylinder to close the cylinder. A top insulator is releasably matable to the first flap to engage the beverage container. A bottom insulator is releasably matable to the second flap to engage the beverage container. Each of the top insulator and the bottom insulator are comprised of a thermally insulating material. A cooling sleeve is insertable into the cylinder to surround the beverage container. Moreover, the cooling sleeve is comprised of a refrigeratable material such that the cooling sleeve can be refrigerated thereby facilitating the cooling sleeve to cool the beverage container.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
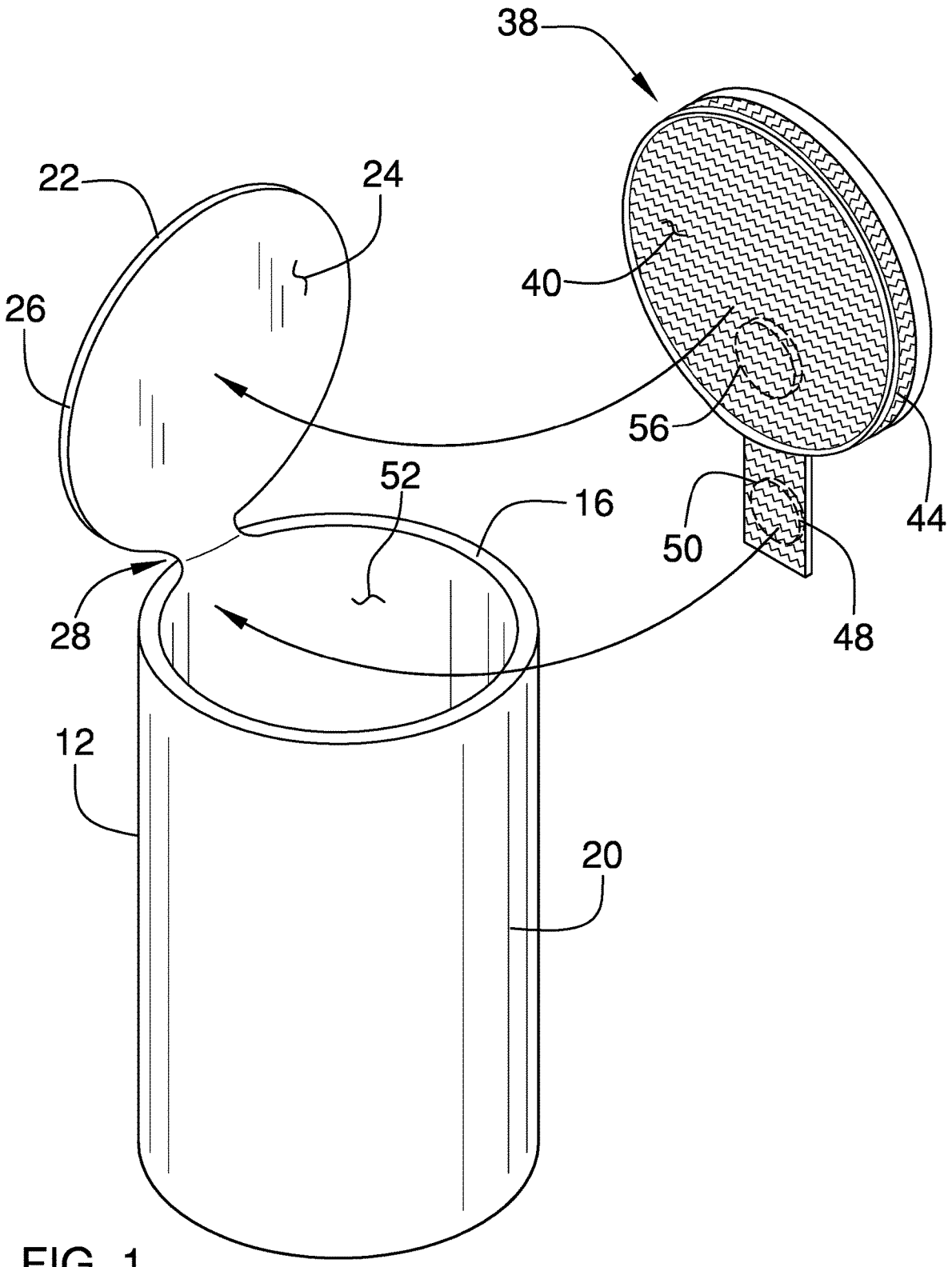
FIG. 1 is a perspective view of an insulated beverage sleeve assembly according to an embodiment of the disclosure showing a cylinder and a top insulator.
Figure 2:
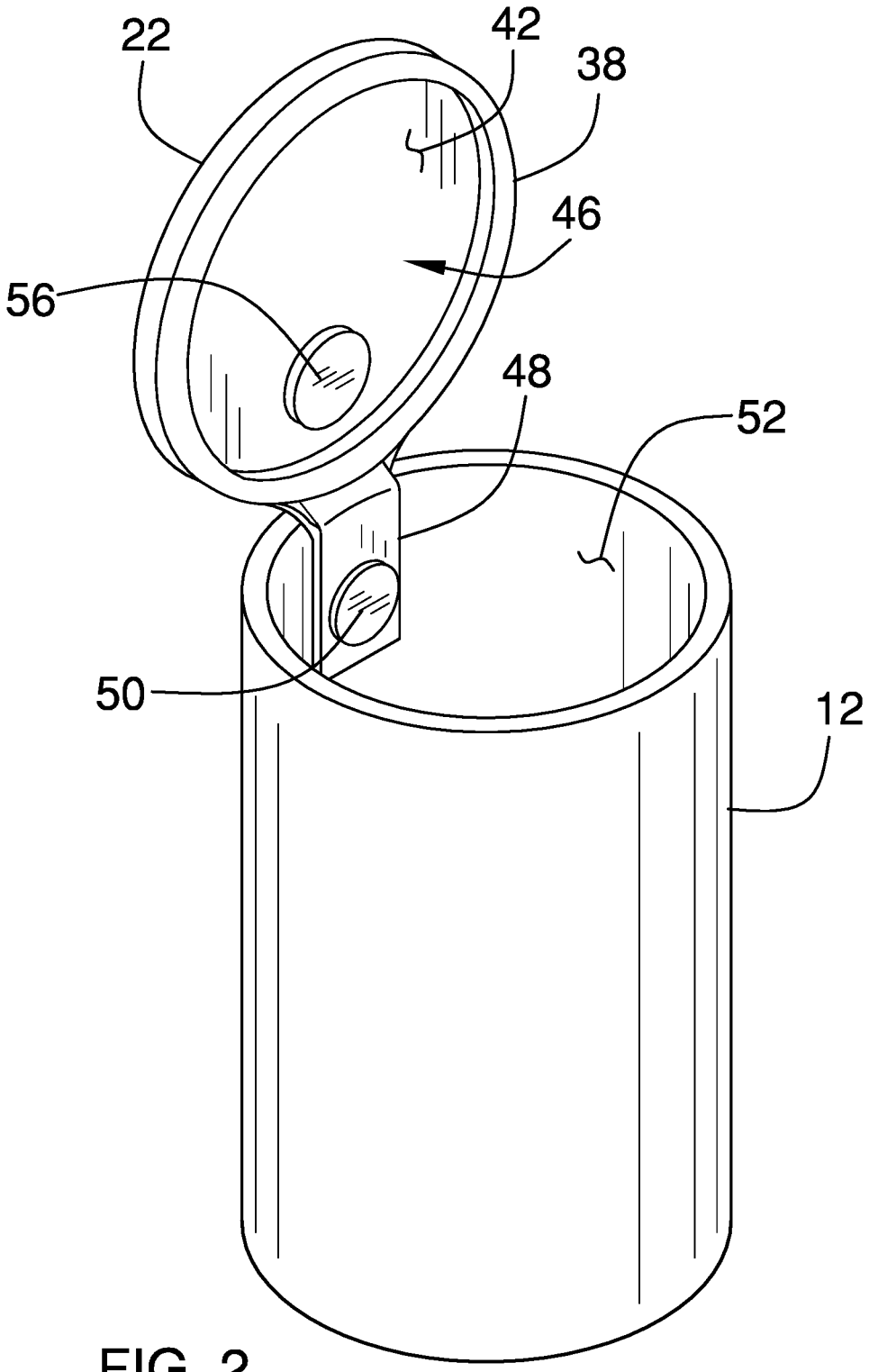
FIG. 2 is a perspective view of an embodiment of the disclosure showing a top insulator being attached to a first flap on a cylinder.
Figure 3:
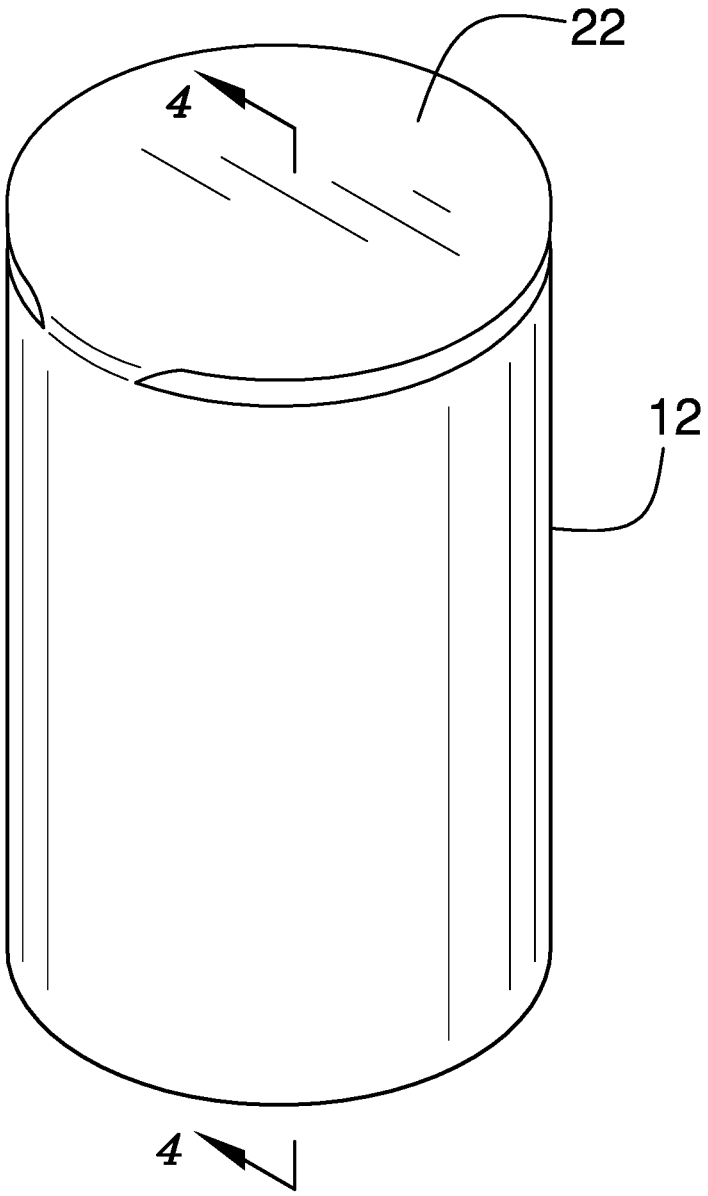
FIG. 3 is a back perspective view of an embodiment of the disclosure showing a first flap being closed on a cylinder.
Figure 4:
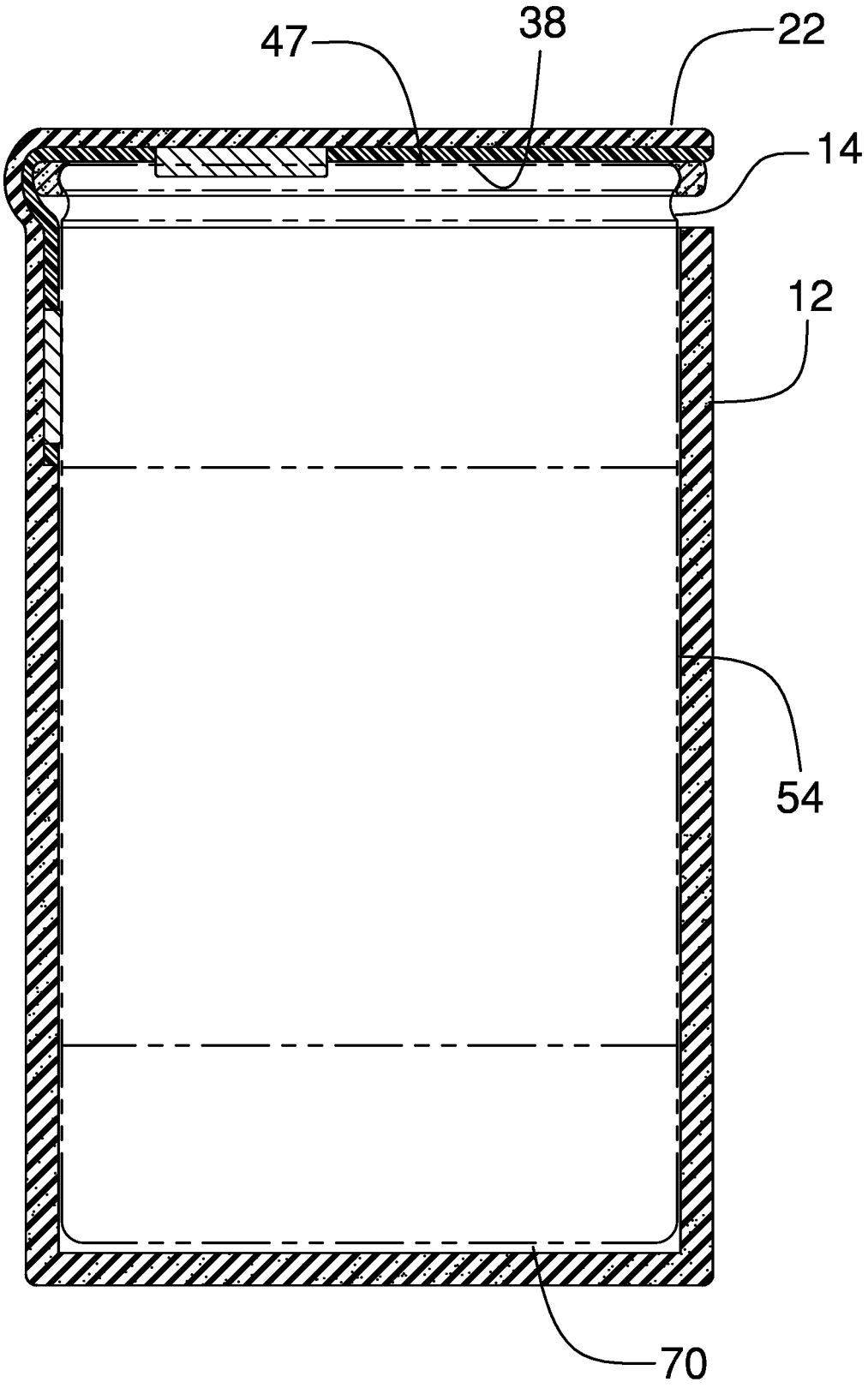
FIG. 4 is a cross sectional view taken along line 4-4 of FIG. 3 of an embodiment of the disclosure.
Figure 5:
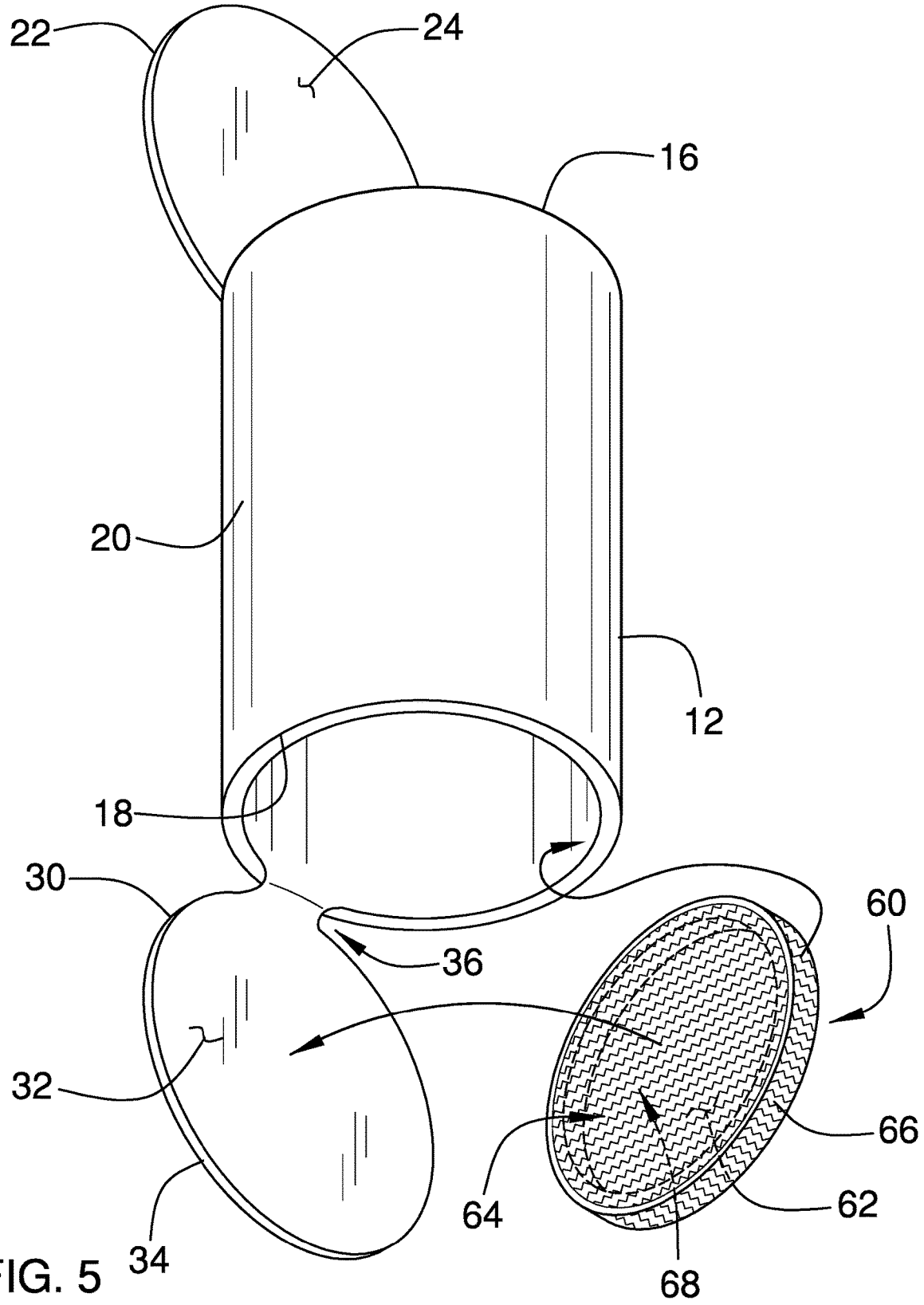
FIG. 5 is a bottom perspective view of an embodiment of the disclosure showing a cylinder and a bottom insulator.
Figure 6:
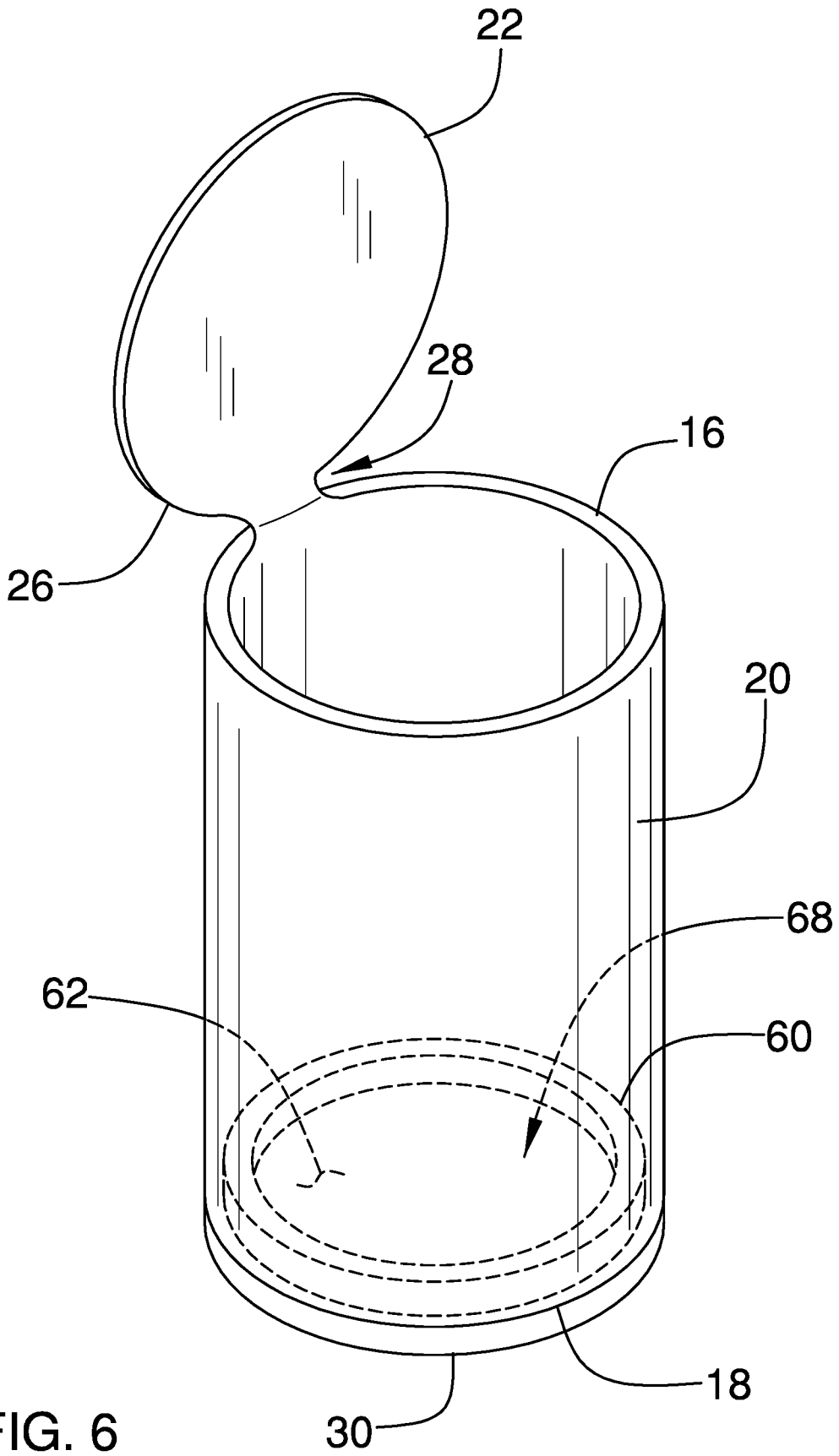
FIG. 6 is a phantom perspective view of an embodiment of the disclosure.
Figure 7:
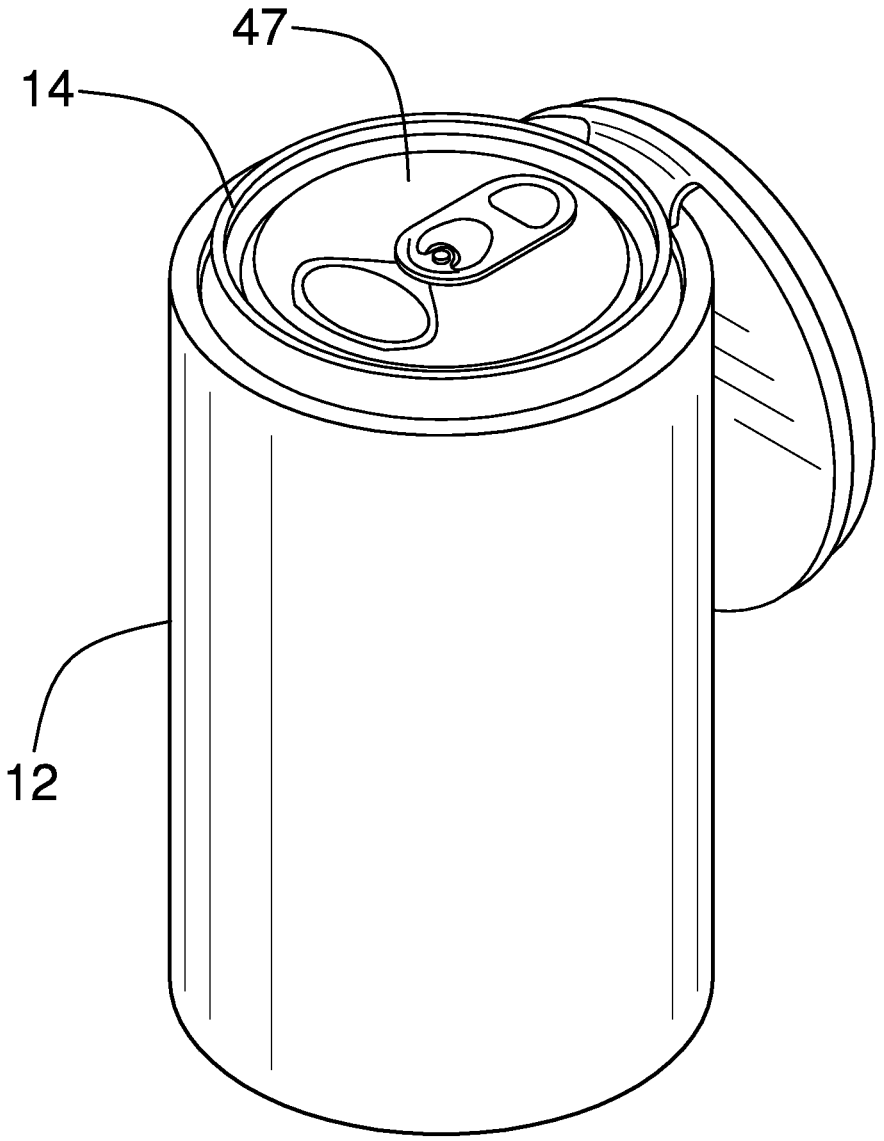
FIG. 7 is a perspective in-use view of an embodiment of the disclosure.
Figure 8:
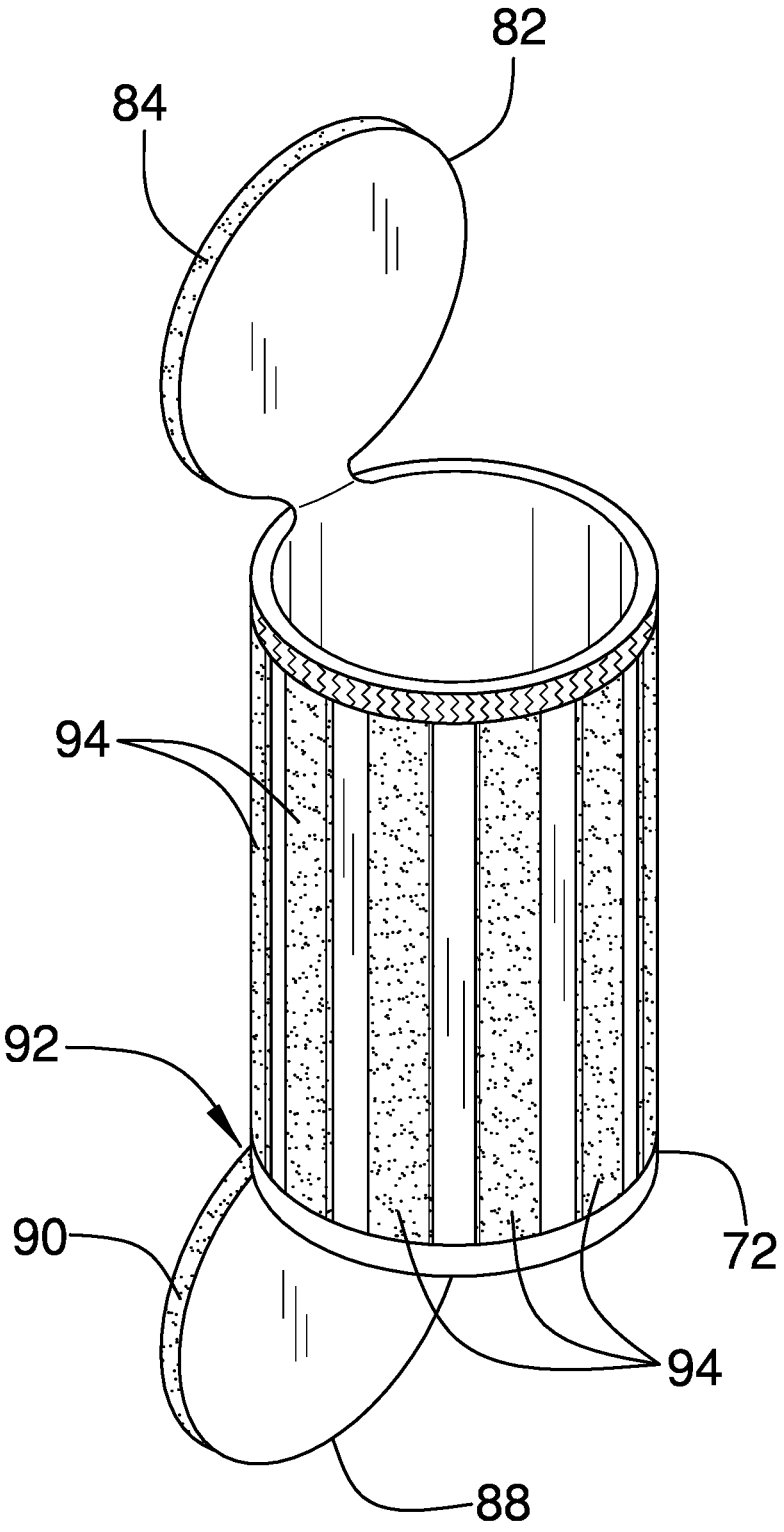
FIG. 8 is a perspective view of cooling sleeve of an embodiment of the disclosure.

With reference now to the drawings, and in particular to FIGS. 1 through 9 thereof, a new beverage sleeve device embodying the principles and concepts of an embodiment of the disclosure and generally designated by the reference numeral 10 will be described.

As best illustrated in FIGS. 1 through 9, the insulated beverage sleeve assembly 10 generally comprises a cylinder 12 that insertably receives a beverage container 14. The beverage container 14 may be an aluminum can or other cylindrical beverage container. The cylinder 12 is comprised of a thermally insulating material to inhibit thermal communication between the beverage container 14 and ambient air. The cylinder 12 has a top end 16, a bottom end 18 and an outer wall 20 extending therebetween, and each of the top end 16 and the bottom end 18 is open.

A first flap 22 is movably attached to the cylinder 12 and the first flap 22 is closeable to close the cylinder 12. The first flap 22 has a bottom surface 24 and a perimeter edge 26, and the perimeter edge 26 is attached to the top end 16 of the cylinder 12 at an attachment point 28 located on the perimeter edge 26. Additionally, the bottom surface 24 rests on the top end 16 of the cylinder 12 when the first flap 22 is closed. A second flap 30 is movably attached to the cylinder 12 and the second flap 30 is closeable to close the cylinder 12. The second flap 30 has a top surface 32 and a perimeter edge 34, and the perimeter edge 34 of the second flap 30 is attached to the bottom end 18 of the cylinder 12 at an attachment point 36 located on the perimeter edge 26 of the second flap 30. The top surface 32 rests on the bottom end 18 of the cylinder 12 when the second flap 30 is closed.

A top insulator 38 is provided and the top insulator 38 is releasably matable to the first flap 22 to engage the beverage container 14. The top insulator 38 has a first surface 40, a second surface 42 and outer edge 44 extending therebetween. Each of the first surface 40 and the outer edge 44 comprises a fabric engaging material. In this way the first surface 40 is releasably matable to the bottom surface 24 of the first flap 22 and the outer edge 44 is releasably matable to an inside surface of the outer wall 20 of the cylinder 12 when the first flap 22 is closed. The cylinder 12 may be comprised of neoprene and the fabric engaging material may comprise a hook portion of a hook and loop fastener.

The second surface 42 has a well 46 extending toward the second surface 42 to accommodate a top 47 of the beverage container 14. The outer edge 44 has a tab 48 extending away therefrom and the tab 48 is comprised of a fabric engaging material. In this way the tab 48 is releasably matable to the inside surface of the outer wall 20 of the cylinder 12. Moreover, the top insulator 38 is comprised of a thermally insulating material to retain the beverage container 14 at a selected temperature. The tab 48 may be comprised a hook portion of a hook and loop fastener.

A first magnet 50 is coupled to the tab 48 such that the first magnet 50 is exposed when the tab 48 is mated to an inside surface 52 of the outer wall 20 of the cylinder 12. Additionally, the first magnet 50 may engage a ferromagnetic surface, such as a refrigerator door, for storing the top insulator 38. A second magnet 56 is coupled to the second surface 42 of the insulator such that the second magnet 56 is positioned in the well. In this way the second magnet 56 can magnetically engage the first magnet 50 when the first flap 22 is opened and laid down on the outer wall 20 of the cylinder 12. Thus, the first flap 22 can be secured when the first flap 22 is not closed over the cylinder 12. Additionally, the second magnet 56 may engage a ferromagnetic surface, such as the refrigerator door, for storing the top insulator 38.

A bottom insulator 60 is releasably matable to the second flap 30 to engage the beverage container 14. The bottom insulator 60 has an upper surface 62, a lower surface 64 and an outer edge 66 extending therebetween. Moreover, each of the lower surface 64 and the outer edge 66 of the bottom insulator 60 is comprised of a fabric engaging material. In this way the lower surface 64 is releasably mated to the top surface 32 of the second flap 30 and the outer edge 66 of the bottom insulator 60 is releasably mated to the inside surface 52 of the outer wall 20 of the cylinder 12. The upper surface 62 has a well 68 extending toward the lower surface 64 to receive a bottom 70 of the beverage container 14. Additionally, the bottom insulator 60 is comprised of a thermally insulating material to retain the beverage container 14 at a preferred temperature.

A cooling sleeve 72 is insertable into the cylinder 12 such that the cooling sleeve 72 surrounds the beverage container 14. The cooling sleeve 72 is comprised of a refrigeratable material such that the cooling sleeve 72 can be refrigerated. In this way the cooling sleeve 72 can cool the beverage container 14 when the beverage container 14 is inserted into the cooling sleeve 72 when the cooling sleeve 72 is inserted in the cylinder 12. The cooling sleeve 72 has an upper end 74 and a lower end 76, and a mating member 78 is coupled to and extends around an outer surface 80 of the cooling sleeve 72. Moreover, the mating member 78 is aligned with the upper end 74. The mating member 78 releasably engages the inside surface 52 of the outer wall 20 of the cylinder 12 when the cooling sleeve 72 is inserted into the cylinder 12 for releasably engaging the cylinder 12.

A first cooling flap 82 is provided and the first cooling flap 82 is movably attached to the cooling sleeve 72. The first cooling flap 82 has an outer edge 84 that is coupled to the upper end 74 of the cooling sleeve 72 at an attachment point 86 located on the outer edge 44 of the first cooling flap 82 for closing the upper end 74. A second cooling flap 88 is provided and the second cooling flap 88 is movably attached to the cooling sleeve 72. The second cooling flap 88 has an outer edge 90 that is coupled to the lower end 76 of the cooling sleeve 72 at an attachment point 92 located on the outer edge 44 of the second cooling flap 88 for closing the lower end 76. Each of the first cooling flap 82 and the second cooling flap 88 may be comprised of neoprene thereby facilitating the top insulator 38 and the bottom insulator 60 to be attached to the respective first cooling flap 82 and second cooling flap 88.

Figure 9:
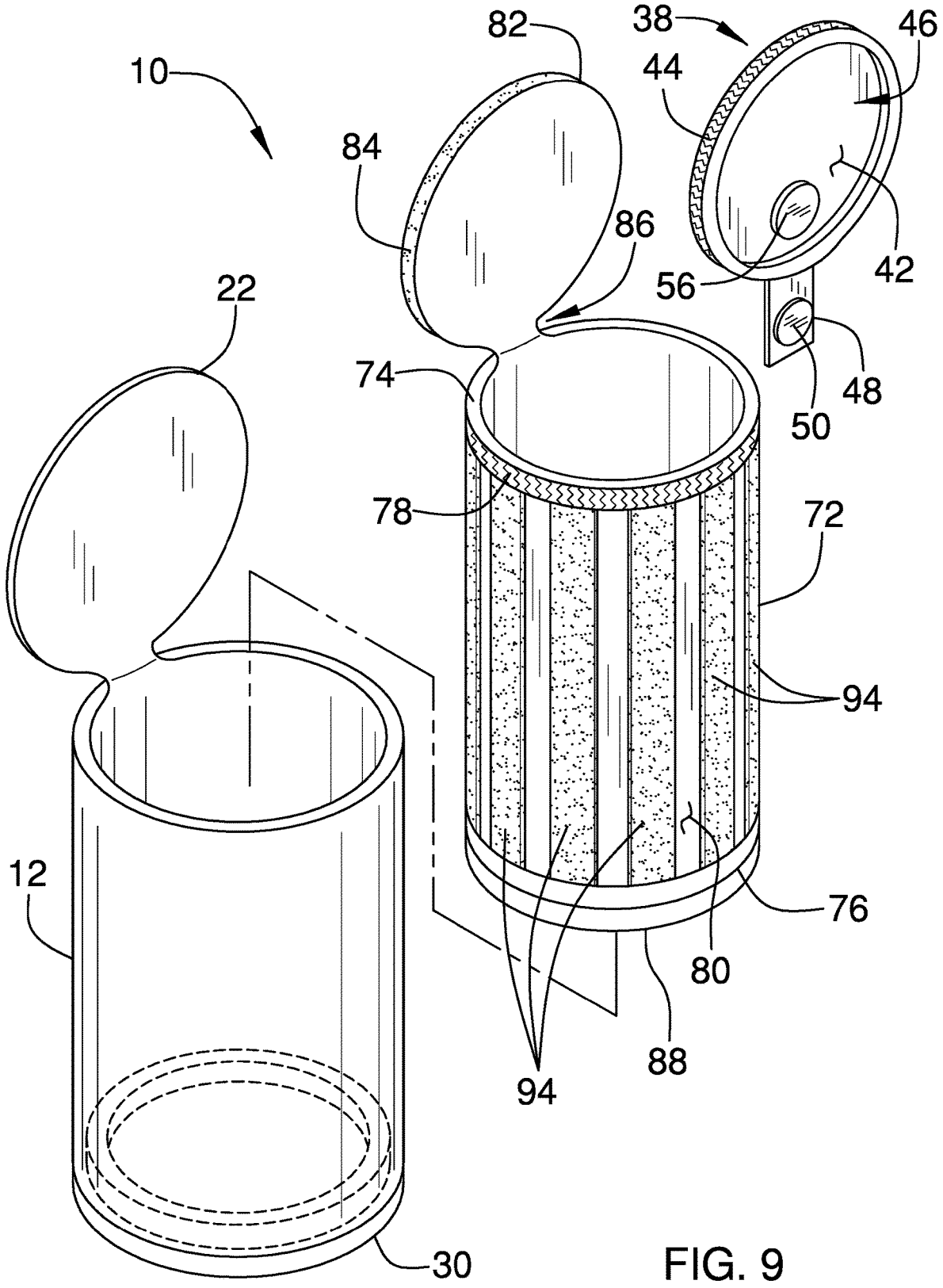
FIG. 9 is an explode perspective view of an embodiment of the disclosure.

As is most clearly shown in FIG. 9, the cooling sleeve 72 may include a plurality of cells 94 that each extend between the upper end 74 and the lower end 76 of cooling sleeve 72. Additionally, the cells 94 may be spaced apart from each other and may be distributed around a full circumference of the cooling sleeve 72. Each of the cells 94 may be comprised of a thermal gel material, such as diethylene glycol or ethylene glycol, that can be repeatedly refrigerated and that will remain at a cooled temperature for an extended period of time.

In use, the beverage container 14 can be inserted into the cylinder 12 and each of the first flap 22 and the second flap 30 can be closed to contain the beverage container 14 in the cylinder 12. Additionally, the top insulator 38 can be attached to the first flap 22 and the bottom insulator 60 can be attached to the second flap 30. In this way the top insulator 38 and the bottom insulator 60 not only thermally insulate the beverage container 14, but also releasably retain the first flap 22 and the second flap 30 in the closed position. Moreover, insects and debris are inhibited from entering the beverage container 14 when the beverage container 14 is positioned in the cylinder 12. The cooling sleeve 72 can be refrigerated and subsequently inserted into the cylinder 12 thereby facilitating the beverage container 14 to be inserted into the cooling sleeve 72. In this way the beverage container 14 can be cooled while the beverage container 14 is positioned in the cylinder 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. An insulated beverage sleeve assembly comprising:

a cylinder being configured to insertably receive a beverage container, said cylinder being comprised of a thermally insulating material wherein said. cylinder is configured to inhibit thermal communication between the beverage container and ambient air;

a first flap being movably attached to said cylinder, said first flap being closeable to close said cylinder;

a second flap being movably attached to said cylinder, said second flap being closeable to close said cylinder;

a top insulator being releasably matable to said first flap wherein said top insulator is configured to engage the beverage container, said top insulator being comprised of a thermally insulating material wherein said top insulator is configured to retain the beverage container at a selected temperature;

a bottom insulator being releasably matable to said second flap wherein said bottom insulator is configured to engage the beverage container, said bottom insulator being comprised of a thermally insulating material wherein said configured to retain the beverage container at the selected temperature;

a cooling sleeve being insertable into said cylinder wherein said cooling sleeve is configured to surround the beverage container, said cooling sleeve being comprised of a refrigeratable material wherein said cooling sleeve is configured to be refrigerated thereby facilitating said cooling sleeve to cool the beverage container;

wherein said cylinder has a top end, a bottom end and an outer wall extending therebetween, each of said top end and said bottom end being open;

wherein said first flap has a bottom surface and a perimeter edge, said perimeter edge being attached to said top end of said cylinder at an attachment point located on said perimeter edge, said bottom surface resting on said top end of said cylinder when said first flap is closed;

wherein said top insulator has a first surface, a second surface and outer edge extending therebetween, each of said first surface and said outer edge comprising a fabric engaging material such that said first surface is releasably matable to said bottom surface of said first flap and said outer edge is releasably matable to an inside surface of said outer wall of said cylinder When said first flap is closed;

wherein said second surface has a well extending toward said second surface wherein said well is configured to accommodate a top end of the beverage container said outer edge having a tab extending away therefrom, said tab being comprised of a fabric engaging material such that said tab is releasably matable to said inside surface of said outer wall of said cylinder;

a first magnet being coupled to said tab such that said first magnet is exposed when said tab is mated to said inside surface of said outer wall of said cylinder; and a second magnet being coupled to said second surface of said insulator such that said second magnet is positioned in said well, said second magnet magnetically engaging said first magnet through said outer wall when said first flap is folded over said outer wall of said cylinder such that said first flap is secured to said outer wall when said first flap is not closed on said cylinder.

2. The assembly according to claim 1, wherein:

said cylinder has a top end, a bottom end and an outer wall extending therebetween, each of said top end and said bottom end being open;

said second flap has a top surface and a perimeter edge, said perimeter edge of said second flap being attached to said bottom end of said cylinder at an attachment point located on said perimeter edge of said second flap, said top surface resting on said bottom end of said cylinder when said second flap is closed.

3. The assembly according to claim 2, wherein said bottom insulator has an upper surface, a lower surface and an outer edge extending therebetween, each of said lower surface and said outer edge of said bottom insulator being comprised of a fabric engaging material such that said lower surface is releasably mated to said top surface of said second flap and said outer edge of said bottom insulator is releasably mated to said inside surface of said outer wall of said cylinder.

4. The assembly according to claim 3, wherein said upper surface has a well extending toward said lower surface wherein said well in said upper surface is configured to receive a bottom end of the beverage container.

5. The assembly according to claim 1, wherein:

said cooling sleeve has an upper end and a lower end; and said assembly includes a mating member being coupled to and extending around an outer surface of said cooling sleeve, said mating member being aligned with said upper end, said mating member releasably engaging an inside surface of an outer wall of said cylinder when said cooling sleeve is inserted into said cylinder for releasably engaging said cylinder.

6. The assembly according to claim 5, further comprising a first cooling flap being movably attached to said cooling sleeve, said first cooling flap having an outer edge being coupled to said upper end of said cooling sleeve at an attachment point located on said outer edge of said first cooling flap for closing said upper end.

7. The assembly according to claim 6, further comprising a second cooling flap being movably attached to said cooling sleeve, said second cooling flap having an outer edge being coupled to said lower end of said cooling sleeve at an attachment. point located on said outer edge of said second cooling flap for closing said lower end.

8. An insulated beverage sleeve assembly comprising:

a cylinder being configured to insertably receive a beverage container, said cylinder being comprised of a thermally insulating material wherein said cylinder is configured to inhibit thermal communication between the beverage container and ambient air, said cylinder having a top end, a bottom end and an outer wall extending therebetween, each of said top end and said bottom end being open;

a first flap being movably attached to said cylinder, said first flap being closeable to close said cylinder, said first flap having a bottom surface and a perimeter edge, said perimeter edge being attached to said top end of said cylinder at an attachment point located on said perimeter edge, said bottom surface resting on said top end of said cylinder when said first flap is closed;

a second flap being movably attached to said cylinder, said second flap being closeable to close said cylinder, said second flap having a top surface and. a perimeter edge, said perimeter edge of said second flap being attached to said bottom end of said cylinder at an attachment point located on said perimeter edge of said second flap, said top surface resting on said bottom end of said cylinder when said second flap is closed;

a top insulator being releasably matable to said first flap wherein said top insulator is configured to engage the beverage container, said top insulator having a first surface, a second surface and outer edge extending therebetween, each of said first surface and said outer edge comprising a fabric engaging material such that said first surface is releasably matable to said bottom surface of said first flap and said outer edge is releasably matable to an inside surface of said outer wall of said cylinder when said first flap is closed, said second surface haying a well extending toward said second surface wherein said well is configured to accommodate a top end of the beverage container, said outer edge having a tab extending away therefrom, said tab being comprised of a fabric engaging material such that said tab is releasably matable to said inside surface of said outer wall of said cylinder, said top insulator being comprised of a thermally insulating material wherein said top insulator is configured to retain the beverage container at a selected temperature;

a first magnet being coupled to said tab such that said first magnet is exposed when said tab is mated to said inside surface of said outer wall of said cylinder;

a second magnet being coupled to said second surface of said insulator such that said second magnet is positioned in said well, said second magnet magnetically engaging said first magnet through said outer wall when said first flap is folded over said outer wall of said cylinder such that said first flap is secured to said outer wall when said first flap is not closed on said cylinder;

a bottom insulator being releasably matable to said second flap wherein said bottom insulator is configured to engage the beverage container, said bottom insulator having an upper surface, a lower surface and an outer edge extending therebetween, each of said lower surface and said outer edge of said bottom insulator being comprised of a fabric engaging material such that said lower surface is releasably mated to said top surface of said second flap and said outer edge of said bottom insulator is releasably mated to said inside surface of said outer wall of said cylinder, said upper surface having a well extending toward said lower surface wherein said well in said upper surface is configured to receive a bottom end of the beverage container, said bottom insulator being comprised of a thermally insulating material wherein said configured to retain the beverage container at the selected temperature;

a cooling sleeve being insertable into said cylinder wherein said cooling sleeve is configured to surround the beverage container, said cooling sleeve being comprised of a refrigeratable material wherein said cooling sleeve is configured to be refrigerated thereby facilitating said cooling sleeve to cool the beverage container, said cooling sleeve having an upper end and a lower end;

a mating member being coupled to and extending around an outer surface of said cooling sleeve, said mating member being aligned with said upper end, said mating member releasably engaging an inside surface of said outer wall of said cylinder when said cooling sleeve is inserted into said cylinder for releasably engaging said cylinder;

a first cooling flap being movably attached to said cooling sleeve, said first cooling flap having an outer edge being coupled to said upper end of said cooling sleeve at an attachment point located on said outer edge of said first cooling flap for closing said upper end; and a second cooling flap being movably attached to said cooling sleeve, said second cooling flap having an outer edge being coupled to said lower end of said cooling sleeve at an attachment point located on said outer edge of said second cooling flap for closing said lower end.

* * * * *